US006224320B1

(12) United States Patent
Klenk

(10) Patent No.: US 6,224,320 B1
(45) Date of Patent: May 1, 2001

(54) DEVICE FOR GUIDING VERTICALLY MOVABLE SHEET PILE CARRIERS

(75) Inventor: Rainer Klenk, St. Leon-Rot (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 08/950,918

(22) Filed: Oct. 15, 1997

(30) Foreign Application Priority Data

Oct. 15, 1996 (DE) ..... 196 42 479

(51) Int. Cl.[7] ..... B65H 31/08
(52) U.S. Cl. ..... 414/790.8; 271/158; 414/924
(58) Field of Search ..... 187/251; 271/158, 271/159; 414/790.8, 924, 926

(56) References Cited

U.S. PATENT DOCUMENTS

| | | | | |
|---|---|---|---|---|
| 3,180,638 | | 4/1965 | Meylan . | |
| 4,189,270 | | 2/1980 | Ehrlich . | |
| 5,014,974 | * | 5/1991 | Jones et al. | 414/790.8 X |
| 5,190,281 | * | 3/1993 | Cardenas | 414/790.8 X |
| 5,240,369 | * | 8/1993 | Voss et al. | 414/790.8 |
| 5,529,456 | | 6/1996 | Luxem et al. | 414/795.8 |
| 5,538,238 | | 7/1996 | Filsinger | 271/159 |

FOREIGN PATENT DOCUMENTS

| | | |
|---|---|---|
| 1808257 | 5/1970 | (DE) . |
| 3922803A1 | 1/1990 | (DE) . |
| 4029919C1 | 4/1992 | (DE) . |
| 4131014A1 | 3/1993 | (DE) . |
| 4129165C2 | 7/1993 | (DE) . |
| 4238616C1 | 2/1994 | (DE) . |
| 4344361A1 | 9/1994 | (DE) . |
| 4424287A1 | 1/1996 | (DE) . |

* cited by examiner

*Primary Examiner*—Janice L. Krizek
(74) *Attorney, Agent, or Firm*—Herbert L. Lerner; Laurence A. Greenberg; Werner H. Stemer

(57) ABSTRACT

A device for guiding vertically movable sheet pile carriers for receiving thereon sheets of a substantially horizontally oriented, continuous stream of sheets including a pile lifter having a main pile support and an auxiliary pile support displaceable back and forth between a readiness position located outside the sheet stream, and a catching position located inside the sheet stream and, when the main pile is being changed, temporarily carrying, in the form of an auxiliary pile, some of the sheets coming from the sheet stream, includes an auxiliary pile frame embracing the displaceable auxiliary pile support and being guidable, jointly with guiding devices of the auxiliary pile support, in vertically extending guide elements.

6 Claims, 3 Drawing Sheets

DEVICE FOR GUIDING VERTICALLY MOVABLE SHEET PILE CARRIERS

BACKGROUND OF THE INVENTION

1. Field of the Invention

The invention relates to a device for guiding vertically movable sheet pile carriers, particularly in deliveries of a sheet processing machine.

The published German Patent Document DE 40 29 919 C1 relates to a device for stacking sheets. Heretofore known are devices for stacking sheets, such as paper or cardboard, especially, on a pallet, those devices having a liftable and lowerable deposition platform on which the pallet rests during stacking, and an auxiliary stacking platform, which can be moved into the region of the deposition platform, for temporarily storing the sheets during a change of pallet. In the embodiment of the device disclosed in the aforementioned published German Patent Document DE 40 29 919 C1, the height of the pallet is determined by a vertically movable scanner element that can be placed on the surface of the pallet and moved over the entire surface thereof. To that end, during the movement of the scanning element over the pallet surface, the maximum upward deflection is measured. The thus-determined pallet height ensures the transfer without difficulty of a temporary sheet pile from the auxiliary stacking platform onto a new pallet.

The auxiliary stacking platform, which can be lowered into stands or pedestals on the entry side, is supported in carriagelike elements, while the deposition platform is movable by being suspended from chains. The deposition platform is held in a freely suspended manner on the chain elements.

The published German Patent Document DE 39 22 803 A1 relates to an automatic sheet pile loading device for a sheet feeder device. The embodiment disclosed therein relates to an automatically operating sheet pile loading device for a paper sheet feeder device having a main lifting device for receiving thereon a sheet pile to be transported. The main lifting device is moved upwardly in stages in order to bring the uppermost sheet of the pile to a predetermined height position with respect to a sheet separator, which is disposed above the sheet pile and takes the sheets individually from the pile. When the sheet pile has been used up, for the most part, horizontally disposed parallel skewers are inserted beneath the stack from both transverse sides of the pile in order to lift the pile load and to lower the main lifting apparatus to accommodate a new sheet pile. The insertion of the skewers in a transverse direction of the pile is advantageous inasmuch as the middle portion of the sheets in the pile can be kept at a constant height in the transport direction of the sheets, regardless of the downward sagging of the skewers, thus making it unnecessary to adjust the position of the sheet separator.

In the version disclosed in the last-mentioned published German patent document, the auxiliary lifting apparatuses are secured to chainlike lifting components and are introduced from the side.

The published German Patent Document DE 43 44 361 A1 relates to a device for forming individual sheet piles. In a device suitable for non-stop operation of, for example, a delivery of a sheet-fed rotary printing press, in which sheets of a sheet stream are combined into individual piles, the piles, respectively, rest on a pile support having a pile bearing surface which is interrupted by grooves. Auxiliary sheet piles are carried by grid bars combined into a rake until the auxiliary sheet piles are transferred to the pile support.

To avoid impairments of the pile due to the weight thereof, a catch plate is provided, in accordance with the invention, which catches, from below, the auxiliary pile deposited on the grid bars which are located in a catching position.

As can be learned from the last-mentioned German Patent Document DE 43 44 361 A1, both the pile support and the frame for the rake are suspended from chains. In such pile supports carried in a freely suspended manner in chains, and especially in auxiliary pile supports, factors such as thrusts or shocks or the like exerted from outside can negatively impact the insertion of the auxiliary pile support and the insertion path to be traversed thereby, so that, at the least, the pile changing operation may be accompanied by imprecision.

SUMMARY OF THE INVENTION

Based on the prior art discussed above, it is accordingly an object of the invention to provide an apparatus for guiding vertically movable sheet pile carriers, more particularly, in an automatically operated non-stop device, which guides the main and auxiliary sheet piles so that vibration does not occur, and guides the auxiliary sheet piles so that axial forces arising as the auxiliary pile carriers are inserted and removed can be absorbed.

With the foregoing and other objects in view, there is provided, in accordance with the invention, a device for guiding vertically movable sheet pile carriers for receiving thereon sheets of a substantially horizontally oriented, continuous stream of sheets including a pile lifter having a main pile support and an auxiliary pile support displaceable back and forth between a readiness position located outside the sheet stream, and a catching position located inside the sheet stream and, when the main pile is being changed, temporarily carrying, in the form of an auxiliary pile, some of the sheets coming from the sheet stream, including an auxiliary pile frame embracing the displaceable auxiliary pile support and being guidable, jointly with guiding devices of the auxiliary pile support, in vertically extending guide elements.

In accordance with another feature of the invention, the device for guiding vertically movable sheet pile carriers includes sliding blocks mountable from the outside and being fastenable to the auxiliary pile frame.

In accordance with a further feature of the invention, the sliding blocks are alignable by at least one adjusting device on the auxiliary pile frame.

In accordance with an added feature of the invention, the device for guiding vertically movable sheet pile carriers includes stop faces formed on the auxiliary pile frame in a region wherein the sliding blocks are mountable thereon.

In accordance with an additional feature of the invention, the device for guiding vertically movable sheet pile carriers includes guiding devices associated with the main pile support and being embodied as ball-headed pins deflectable in two planes.

In accordance with yet another feature of the invention, the guiding devices of the main pile support are relatively movable in sliding blocks.

In accordance with yet a further feature of the invention, the guiding devices of the main pile support are connected to the main pile support via adjusting elements.

In accordance with a concomitant feature of the invention, the main pile support connected via the adjusting elements to the guiding devices of the main pile support is adjustable relative to the adjusting elements.

The embodiment according to the invention advantageously permits the interception of the reaction forces arising as the auxiliary pile support is inserted or removed, and thereby the avoidance of an undesired relative motion between the auxiliary pile frame and the main pile support in the sheet feeding plane. As a result, greater edge accuracy when combining the auxiliary pile and the main pile is attainable, which means less post-processing work for the pressman. The joint vertical guidance of the auxiliary pile frame and the main pile support lends the sheet delivery, typically equipped with chainlike lifting devices, greater stability against external factors and disruptions.

In an advantageous further realization of the concept upon which the invention is based, sliding blocks may be secured from the outside to the auxiliary stack frame. The sliding blocks can be introduced from outside through openings made in the vertically extending guide elements, and screwed to the auxiliary pile frame, for example. Fine adjustment of the auxiliary pile frame with respect to the vertically extending guide elements can be effected by adjusting devices, which are embodied herein, for example, as threaded pins; the adjusting devices are supported on stop faces which are formed on the auxiliary pile frame, and they enable sensitive, play-free lateral alignment of the auxiliary pile frame in the lateral guide elements thereof.

The main pile support which, together with the auxiliary pile support, is also received in the vertically extending guide elements, is supported in sliding blocks via ball-headed pins. The sliding blocks move up and down in the vertical guide elements analogously to the sliding blocks provided on the auxiliary pile frame. Due to the support of the main pile plate by ball-headed pins in the sliding blocks, the auxiliary pile support can move in two planes.

With two adjusting elements that are provided on the main pile plate, the latter can be aligned and adjusted play-free relative to the sliding blocks that are guided in the vertical guide elements.

Other features which are considered as characteristic for the invention are set forth in the appended claims.

Although the invention is illustrated and described herein as embodied in a device for guiding vertically movable sheet pile carriers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
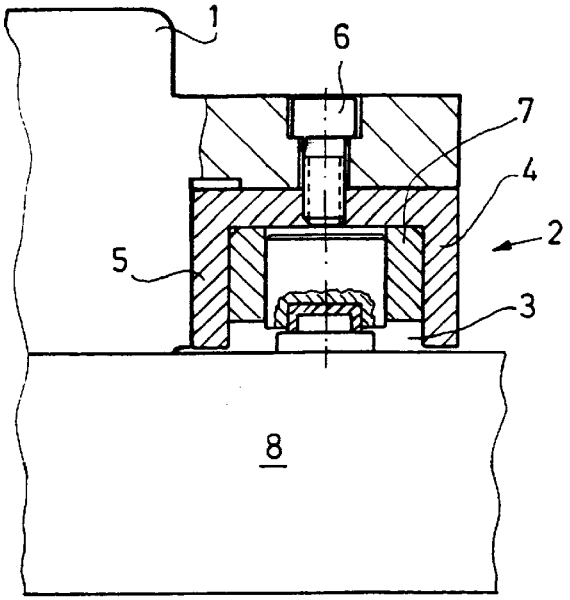
FIG. 1 is a fragmentary plan view, partly in section, of a sliding block guidable in a vertical guide element of a device for guiding vertically movable sheet pile carriers according to the invention.

Referring now to the drawings and, first, particularly, to FIG. 1 thereof, there is shown therein a sliding block guide in a vertical guide element 2 viewed in cross section, a sliding block 7 being secured by a fastening element to an auxiliary pile frame 8 that is movable in the plane of the drawing. The sliding block 7 is preferably formed of especially abrasion-proof plastic material with very good sliding properties. In the embodiment shown in FIG. 1, the guide element 2, which extends perpendicularly to the plane of the drawing, includes two outer legs 4 and 5, between which an opening 3 is formed, which is directed towards the auxiliary pile frame 8 and in which the respective sliding block 7 moves up and down, as viewed in the figure. Through the intermediary of a fastener, such as a bolt 6, the guide element 2, here embodied as a profile strip, can be secured to a side wall 1 of a sheet delivery machine.

Figure 2:
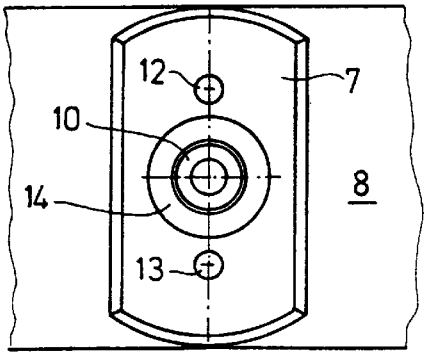
FIG. 2 is a side elevational view of the sliding block.

FIG. 2 shows the sliding block 7 secured to the auxiliary pile frame 8. A bushing 14 is embedded or countersunk into the sliding block 7 and has a fastening screw 10 passing therethrough. Through the intermediary of the screw 10, the sliding block 7 is securely fastened to the auxiliary pile frame 8. The sliding block 7 has two adjusting elements 12 and 13 passing therethrough, the adjusting elements 12 and 13, in the exemplary embodiment shown in FIG. 2, being embodied as pushbutton-type threaded pins. In the position thereof relative to the sliding block 7, the threaded pins 12 and 13 can be screwed easily out of or, from the outside, back into the sliding block 7 by a screwdriver, thus providing for relatively easy rotatability of the frame.

Figure 3:
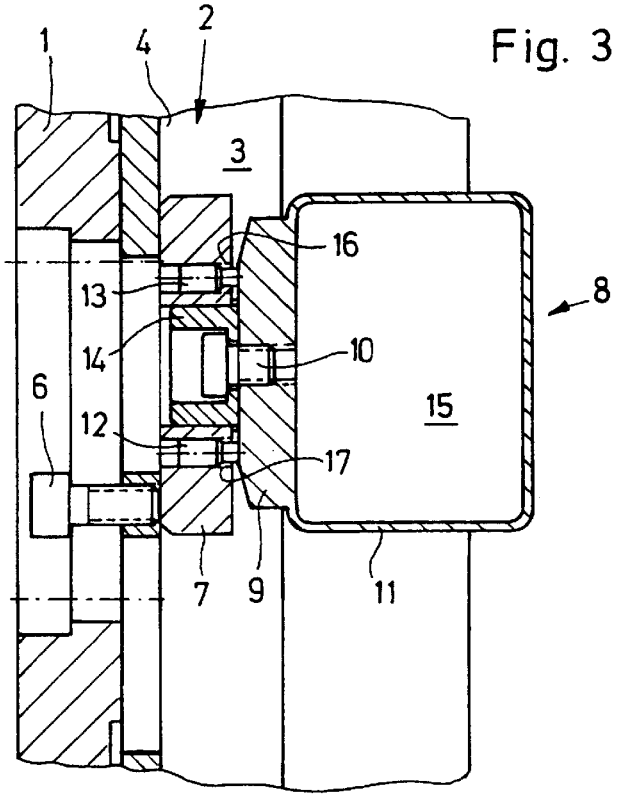
FIG. 3 is a longitudinal sectional view of the sliding block as fastened to an auxiliary pile frame.

As shown in FIG. 3, stop surfaces 9 are formed between the outside of the auxiliary pile frame 8 facing towards the vertically extending guide elements 2, and the sliding block 7. The stop faces 9 are the surfaces whereon the adjusting elements 12 and 13, respectively, are braced during the process of laterally aligning the auxiliary pile frame 8. The adjusting elements 12 and 13 enable a precise setting of the position of the auxiliary pile frame 8 with regard to the vertically extending guide elements 2. The aforementioned bushing 14 is disposed in the middle of the sliding block 7 and, provided in the bushing 14, is a fastening screw 10 by which the sliding block 7 is mounted on the auxiliary pile frame 8. It is also apparent from the view in FIG. 3 that the vertically extending guide elements 2 which, in the opening 3 formed therein, receive the sliding block 7, can be displaced relative to the side wall 1. In this regard, only loosening of the fasteners 6 and, then, displacement of the guide element 2 are required, so that, depending upon the direction of displacement of the profile strip 2, the head of the respective fasteners 6 moves up or down. Thus, while maintaining high rigidity for the common auxiliary and main pile guide elements 2, unevenness of the base or bottom can also be compensated for relatively easily. The vertically extending guide elements 2, after compensating for the unevenness, for example, between the drive side and the control side in the delivery region or from the feeder to the delivery and vice versa, if there is a gradient or drop, are fixed by the fasteners 6, which, in the case at hand, are conventional screws, in the elongated recesses, in terms of the individually ascertained vertical position thereof, so that the guide elements 2 can reliably absorb the incident reaction forces, particularly upon motion of the auxiliary pile support.

With regard to the arrangement shown in FIG. 3, it should also be noted that the adjusting elements 12 and 13 may be embodied as threaded pins, which are movable towards or away from the stop face 9 in threads 16 and 17, respectively, formed in the sliding block 7.

A profile 11 forming the auxiliary pile frame 8 surrounds a hollow chamber 15 wherein non-illustrated drive units required for moving an auxiliary pile support 24 in and out are accommodated.

Figure 4:
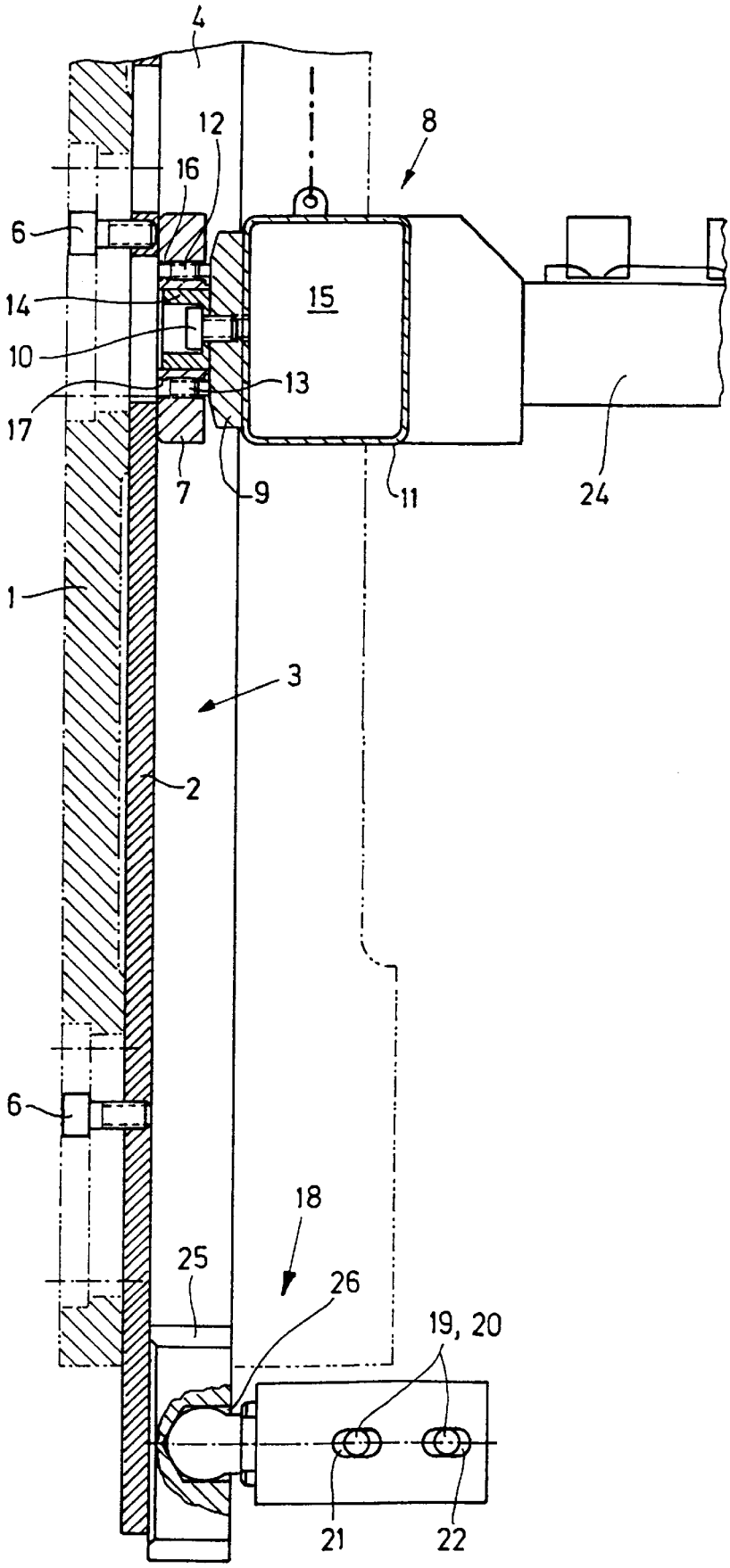
FIG. 4 is a longitudinal sectional view, slightly reduced from that of FIG. 3, of the vertical guide element, including the auxiliary pile frame bearing and a main pile support bearing.

In FIG. 4, a greater fragment of one of the vertically extending guide elements 2 is shown in a sectional view. This view includes both sliding blocks, namely the sliding block 7 associated with the auxiliary pile frame 8 and a sliding block 25 associated with a main pile support 23 (note FIG. 5). In FIG. 4, there is shown an auxiliary pile support 24 for the auxiliary pile frame 8 which is movable along the auxiliary stack frame 8 perpendicularly to the plane of the drawing of FIG. 4. This auxiliary pile support 24 is set into motion by the aforementioned non-illustrated drive units which are located in the hollow chamber or chambers 15 of the auxiliary pile frame 8.

The guide elements 2 constructed in FIG. 4 as profile strips are screwed to the side wall 1, with the opening 3 formed in the guide elements 2 being directed towards the auxiliary pile frame 8 or main pile support 23. Once the fastener 6 is released, the guide elements 2 can be displaced as needed along the side wall 1, and then fastened again. In the lower part of FIG. 4, the sliding block 25 is shown formed with an opening 26 wherein a ball-headed pin 18 is received. The ball-headed pin 18 is joined to the main pile support 23 by an angle iron. The ball-headed pin 18 permits the main pile support 23 to move in two planes. At the angle at which the head of the ball-headed pin is disposed, adjusting elements 19 and 20 are provided (note also FIGS. 5 and 6). Through the intermediary of a bearing for the head of the ball-headed pin 18 of the main pile support 23 in the sliding blocks 25, only one of which is shown in FIG. 4 because the sliding block guided in the opposite guide element is omitted in the interest of clarity and due to a lack of sufficient space, the main pile support 23 can fit precisely in the sliding block 25. Slight compensating movements are possible. The adjusting elements 19 and 20 are guided in slots 21 and 22, for example, and permit an exact, play-free lateral alignment of the main pile support 23.

Figure 6:
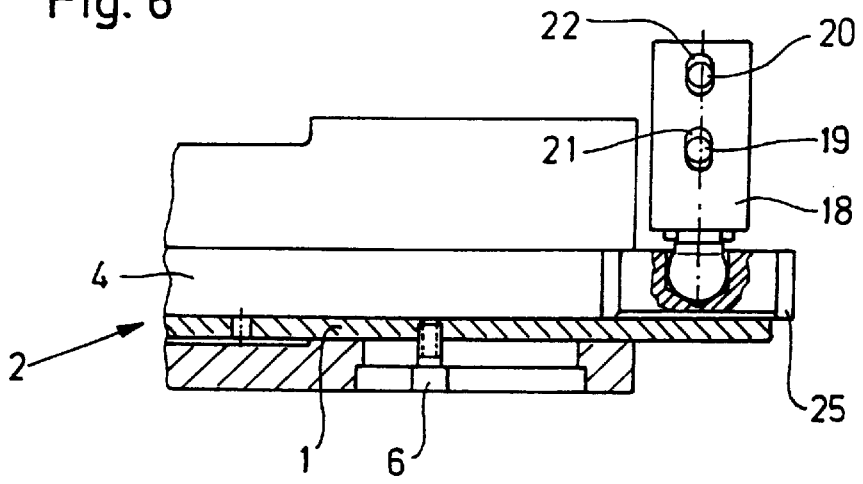
FIG. 6 is a side elevational view of the sliding block and the bearing thereof as shown in FIG. 5.
Figure 5:
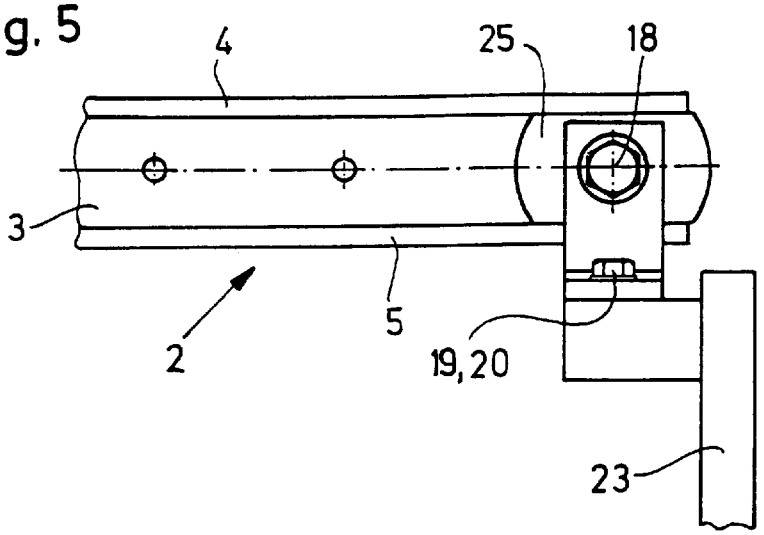
FIG. 5 is a plan view of an embodiment of a sliding block for the main pile support.

FIGS. 5 and 6 show the ball-headed pin bearing of the main stack support 23 in the sliding blocks. On the vertically extending guide element 2, which is shown in FIG. 6 rotated through an angle of 90° from the view thereof in FIG. 5, the sliding block 25 is guided in the opening 3 between the legs 4 and 5. The head of the ball-headed pin 18 is received in the sliding block 25; the adjusting elements 19 and 20 which, in the exemplary embodiment, are in the form of screws, are shown in a side view. Through the intermediary of the adjusting elements 19 and 20, the main pile support 23 can be adjusted laterally free of any play. As shown in FIG. 6, the guide element 2 is adjustably supported in recesses formed in the side wall 1. The front leg 5 of FIG. 5 is not shown in FIG. 6; the rear leg 4 is formed with the guide surface for the displaceable sliding block 25 of the main pile support 23.

The mode of operation of the vertically extending guide elements 2 on both sides of the auxiliary pile frame 8 and the main pile support 23 is described hereinafter. Both on the main pile support 23 and on the auxiliary pile frame 8, there are sliding blocks 7 and 25, respectively, which are movable up and down in the openings 3 of the vertically extending guide elements 2. Because the sliding blocks 7 and 25 are prevented from moving horizontally by the legs 4 and 5 laterally defining the openings 3, the auxiliary pile frame 8 and the main pile support 23, which are suspended from chainlike lifting devices and movable vertically up and down thereby, intrinsically have greater stability; inducements to vibration, such as external impacts against the pile supports 23 and 24 or even against the lowerable auxiliary pile frame 8 can no longer, because of the vertical guidance, cause vibration and consequent inaccurate edge formation during pile formation or buildup. Not only is the main pile support 23 suspended at four points from the chainlike lifting device, but also the auxiliary pile frame 8 is likewise suspended from chains, by which it is lowered, when the main sheet pile is being changed during production printing by the printing machine, in accordance with the formation or buildup of the auxiliary sheet pile. The chainlike lifting device cannot intercept impacts in the horizontal direction, which is why a sheet delivery including lateral guide profiles, with joint auxiliary pile frame guidance and main pile support guidance, lends the sheet delivery greater stability.

I claim:

1. A device for vertically moving sheet pile carriers comprising:

a main pile support for carrying a main pile;

an auxiliary pile support being horizontally displaceable between a working position located above said main pile support and a readiness position located adjacent the working position;

a frame embracing said auxiliary pile support;

an upright guide having a longitudinal extent, said upright guide formed with an opening aligned along the longitudinal extent;

a first guide element mounted to said main pile support and mounted within said opening of said upright guide for vertical movement along the upright guide; and a second guide element mounted to said frame embracing said auxiliary pile support and mounted within said opening of said upright guide for vertical movement along the upright guide.

2. The device for vertically moving sheet pile carriers according to claim 1, wherein said first guide element includes a sliding block for sliding along said upright guide and said second guide element includes a sliding block for sliding along said upright guide.

3. The device for vertically moving sheet pile carriers according to claim 2, wherein said second guide element is alignable by at least one adjusting device on said frame.

4. The device for vertically moving sheet pile carriers according to claim 1, wherein said frame is provided with a stop face in a region where said second guide element is mounted to said frame.

5. The device for vertically moving sheet pile carriers according to claim 2, wherein said first guide element includes a pin having a ball-head that is slidably inserted into said sliding block.

6. The device for vertically moving sheet pile carriers according to claim 1, wherein said first guide element is mounted to said main pile support via an adjusting element.

* * * * *